US005837061A

United States Patent [19]

Karner et al.

[11] Patent Number: 5,837,061

[45] Date of Patent: Nov. 17, 1998

[54] PICKLED STEEL PRODUCT SUBSEQUENT TREATMENT PROCESS AND DEVICE, IN PARTICULAR FOR PICKLED CARBON STEEL HOT STRIPS

[75] Inventors: Wilhelm Karner, Eichgraben; Karl Jirenec, Maria-Enzersdorf, both of Austria

[73] Assignee: Andritz-Patentverwaltungs-Gesellschaft m.b.H, Graz, Austria

[21] Appl. No.: 581,523

[22] PCT Filed: Jul. 5, 1994

[86] PCT No.: PCT/EP94/02205

§ 371 Date: Apr. 8, 1996

§ 102(e) Date: Apr. 8, 1996

[87] PCT Pub. No.: WO95/02080

PCT Pub. Date: Jan. 19, 1995

[30] Foreign Application Priority Data

Jul. 8, 1993 [AT] Austria ..... 1345/93

[51] Int. Cl.[6] ..... C23G 3/02

[52] U.S. Cl. ..... 134/3; 134/2; 134/28; 134/41; 510/258

[58] Field of Search ..... 134/3, 2, 28, 41; 510/258

[56] References Cited

U.S. PATENT DOCUMENTS

| | | | |
|---|---|---|---|
| 4,536,637 | 8/1985 | Horiuchi et al. | 219/117.1 |
| 5,616,424 | 4/1997 | Carey, II et al. | 428/647 |

OTHER PUBLICATIONS

JP 3020486 (abstract), Jan. 1991.

*Primary Examiner*—Margaret W. Glass
*Attorney, Agent, or Firm*—Alix, Yale & Ristas, LLP

[57] ABSTRACT

In a process for post-treatment of pickled steel products by rinsing with water in continuous rinsing plants, inert gas or rare gas is blown into at least one of the rinsing sections (1,2,3 or 4) of the rinsing plant. This prevents the formation of hydrolysis stains on the surface of the steel products in case of the strip standing still. The device for carrying out the process consists of several rinsing sectors 1, 2, 3, 4, with at least one feed opening 8 for liquid medium, with at least one of the rinsing sections 1,2,3 or 4 being provided with at least one feed opening 19, 20 for blowing in gases.

16 Claims, 2 Drawing Sheets

PICKLED STEEL PRODUCT SUBSEQUENT TREATMENT PROCESS AND DEVICE, IN PARTICULAR FOR PICKLED CARBON STEEL HOT STRIPS

BACKGROUND OF THE INVENTION

The invention relates to a process for the post-treatment of pickled, hot carbon steel strip by application of water in continuous rinsing systems.

It is known that steel material is pickled with acid in order to remove scale. Most modern pickling plants use hydrochloric acid as the pickling medium. After pickling, the residual pickling acid adhered to the material surface, for instance hot strip, must be removed. This is normally done in continuous rinsing systems, such as, for instance, multistage counter-current rinsing systems, which are designed as pressure spray systems in most cases.

The pickling acid entrained with the strip from the last pickling stage enters the rising system and is treated with rinsing water section by section counter-currently to the strip moving direction. This brings about a defined concentration gradient of hydrochloric acid and iron ions in the individual rinsing sections. The rinsing water essentially contains the following substances: Fe(II) ions, Cl ions and H+ions. The H+ion concentration determines the acidity of the rinsing water. This acidity is more appropriately stated as pH value, which is defined as negative decimal logarithm of the H+ion concentration.

As the acid concentration of the rinsing water is reduced, for instance, by progressive dilution, the pH value of the rinsing liquid rises. Starting from a certain critical pH value the iron ions are hydrolised, i.e. the following coupled reactions take place:

$$Fe^{2}++2H_2O \rightarrow >Fe(OH)_2+2H^+$$

$$Fe^{3}++3H_2O \rightarrow >Fe(OH)_3+3H^+$$

The bivalent iron hydroxide $Fe(OH)_2$, very easily oxidises with the atmospheric oxygen to form the trivalent iron hydroxide $Fe(OH)_3$.

$$2Fe(OH)_2+H_2O+\tfrac{1}{2}O_2 \rightarrow >2Fe(OH)_3$$

The sequence of these hydrolysis reactions is to a great extent dependent on the pH value and the temperature. Apart from these physico-chemical influencing factors, the hydrolysis and oxidation reactions are time-dependent. Experience shows that the critical period of time for hydrolysis reactions to occur is about 30 seconds.

In a rinsing system following a pickling plant, the retention time of the strip under normal operating conditions is far shorter than the critical time after which the hydrolysis reactions might commence. Thus, it is impossible for hydrolysis products to be deposited on the strip surface.

However, if the strip is halted due to a malfunction of the pickling operation, depositing of hydrolysis products on the strip surface is inevitable if this failure extends beyond the critical time for hydrolysis reactions. This deposit mainly takes place in the rinsing system's last two rinsing sections, where due to progressive dilution the pH value has risen most. The depositing of hydrolysis products on a metal surface, also called hydrolysis stains, deteriorates the quality of the product. In many cases, material that is strongly contaminated by hydrolysis products is unsuitable for further use. Improvement of the post-treatment of pickled steel products with a view to ensuring advantageous, hydrolysis-restraining conditions constitutes an important technical problem with regard to economy of operations.

Several processes are known to prevent hydrolysis reactions in rinsing systems arranged after pickling plants for steel products:

One method to prevent hydrolysis reactions consists in cooling the rinsing liquid. Due to cooling and on account of the temperature-dependency of the hydrolysis reaction a slight increase of the critical hydrolysis time is achieved.

Experience shows that the factor for the increase of the critical hydrolysis time is about two, i.e. after about 60 seconds of the strip having stood still, hydrolysis products are formed. Operating malfunctions normally last much longer than 60 seconds, and it is thus not possible to achieve a substantial decrease of the hydrolysis stains using this method.

According to another method to prevent hydrolysis reactions, chemicals are added to the rinsing liquid, which inhibit the hydrolysis reactions. Addition of chemicals gives a far better effect than cooling of the rinsing water, but the additives cause problems in the treatment of the rinsing waters in neutralisation systems, for instance, an increase of the COD in the waste water.

SUMMARY OF THE INVENTION

It is the object of the present invention, while obviating the disadvantages of the above-mentioned methods in the post treatment of pickled steel products, in particular pickled, hot carbon steel strip, in continuous rinsing systems, to prevent the formation of hydrolysis products on the surface of such steel products and thus to improve the quality of the surface.

According to the invention, this task is solved by blowing inert gas, such as nitrogen or rare gas, into at least one of the rinsing sections of the rinsing system. It was noted that by blowing in inert gas, the formation of hydrolysis stains on the surface of pickled steel can be completely prevented. By blowing in inert gas, the oxygen content in the rinsing sections is reduced to a point where oxidation of the Fe(II) ions to form Fe(III) ions is not possible and thus the most important partial reaction of hydrolysis is inhibited. No depositing of hydrolysis products takes place, and the quality of the surface of the product is improved.

According to the invention, this task is furthermore solved by blowing carbon dioxide ($CO_2$), into at least one of the rinsing sections of the rinsing system. It was noted here as well that by blowing in carbon dioxide into the rinsing sections the formation of hydrolysis stains on the surface of pickled steel could be completely prevented when the strip was at standstill. By blowing in carbon dioxide carbonate ($CO_3^{2-}$) ions and hydrogen carbonate ($HCO_3-$) ions form, leading to a displacement of the balance of the hydrolysis reaction toward the initial products. In addition, by blowing in inert gas, the oxygen content is naturally also reduced, whereby oxidation of the Fe(II) ions is inhibited.

The task is furthermore solved in an advantageous manner by blowing in a mixture of inert gas, for instance, nitrogen or rare gas, and carbon dioxide. By combining the oxygen-displacing effect of the gases blown in and the chemical effect of the carbon dioxide the efficiency of the process according to the invention is increased.

According to another characteristic of the invention the inert gas and/or the carbon dioxide is advantageously blown into the last rinsing section of the rinsing plant, preferably the last two sections. The probability of depositing of the hydrolysis products is greatest in the last or the last two sections on account of the progressing dilution and the increased pH of the rinsing water, and thus the blowing-in of inert gas and/or carbon dioxide is particularly beneficial at these points for avoiding hydrolysis stains and a resulting improvement of the product's surface quality.

The task is also solved in an advantageous manner by feeding the inert gas and/or carbon dioxide continuously. By feeding the gas used for blowing into the rinsing sections continuously while the pickled steel product passes through the rinsing section, the depositing of hydrolysis products is always prevented and an improvement of the surface quality thus ensured.

Alternatively it may be foreseen that the inert gas and/or carbon dioxide are fed discontinuously. In the case of discontinuous addition, the gas used is not employed until a malfunction occurs, causing the strip to stand still, thus preventing the depositing of hydrolysis products. Compared to continuous feed, this allows reducing the quantity of gas used. Selection of one of the two methods of feeding may be determined by the design and the infrastructure of the plant.

Another advantageous version of the invention provides for the gas used to be blown in above the rinsing liquid. By blowing the gas in from the top a uniform distribution of the gas in the rinsing sections is secured, which safely prevents the depositing of hydrolysis products.

Another advantageous version of the invention provides for the gas used to be blown into the rinsing liquid. This measure gives an even better distribution and mixing of the gas in the rinsing sections compared to blowing in from the top. In addition, an improved displacement of the oxygen dissolved in the rinsing liquid and/or a chemical inhibition of the hydrolysis reactions uniformly in the entire liquid volume of the rinsing liquid.

To solve the task using the process according to the invention a device is further used for post-treatment of the pickled steel strip, in particular pickled hot carbon steel strip, comprising several rinsing sections with at least one feed opening for liquid rinsing medium, preferably water, this device being characterised according to the invention by the fact that at least one rinsing section is provided with at least one feed opening for blowing in gases.

To minimise hydrolysis at the points in the device most prone to it, it is advantageously provided for the last of the rinsing sections, preferably the last two rinsing sections, to be equipped with at least one feed opening for blowing in gases.

Another advantageous version of the invention provides for one of the feed openings to be arranged above the liquid surface. Thus the oxygen above the liquid can quickly be displaced.

Another advantageous version of the invention provides for one of the insertion openings to be arranged under the liquid surface, so that the gas used can be blown direct into the rinsing liquid.

According to another characteristic of the invention at least one circulation blower is provided for blowing in the gas used, preferably with a capacity of 500 to 1000 $m^3/h$. Since it is necessary to decrease the oxygen content within a very short time (approx. 20 seconds) to a low quantity (approx. 1 per cent of volume), by the blowing in of inert gas and/or carbon dioxide, rapid feed of a suitable quantity of inert gas and/or carbon dioxide is required in particular in the case of discontinuous gas feed. Circulation blowers with a capacity of 500 to 1000 $m^3/h$ are suitable for customarily sized rinsing sections in an optimum manner for the feed of the gases to be blown into the rinsing sections.

According to another characteristic of the invention the device is provided with a control unit independent of the power circuit of the rinsing system, which, in case of a standstill of the strip, causes the gases to be blown in. This measure is particularly important in case of discontinuous gas feed. Since a standstill of the strip may be caused, amongst other reasons, by a power failure in the system, it is important for the control unit to be independent of the power circuit to achieve a reliable effect of the process according to the invention.

Finally, in accordance with another characteristic of the invention it is provided for the rinsing sections to be equipped with at least one feed opening each for the inert gas and/or carbon dioxide, to be sealed off against exchange of gas.

BRIEF DESCRIPTION OF THE DRAWINGS

The invention will now be described in more detail, with reference to the accompanying drawings, wherein.

DESCRIPTION OF THE PREFERRED EMBODIMENT

Figure 1:
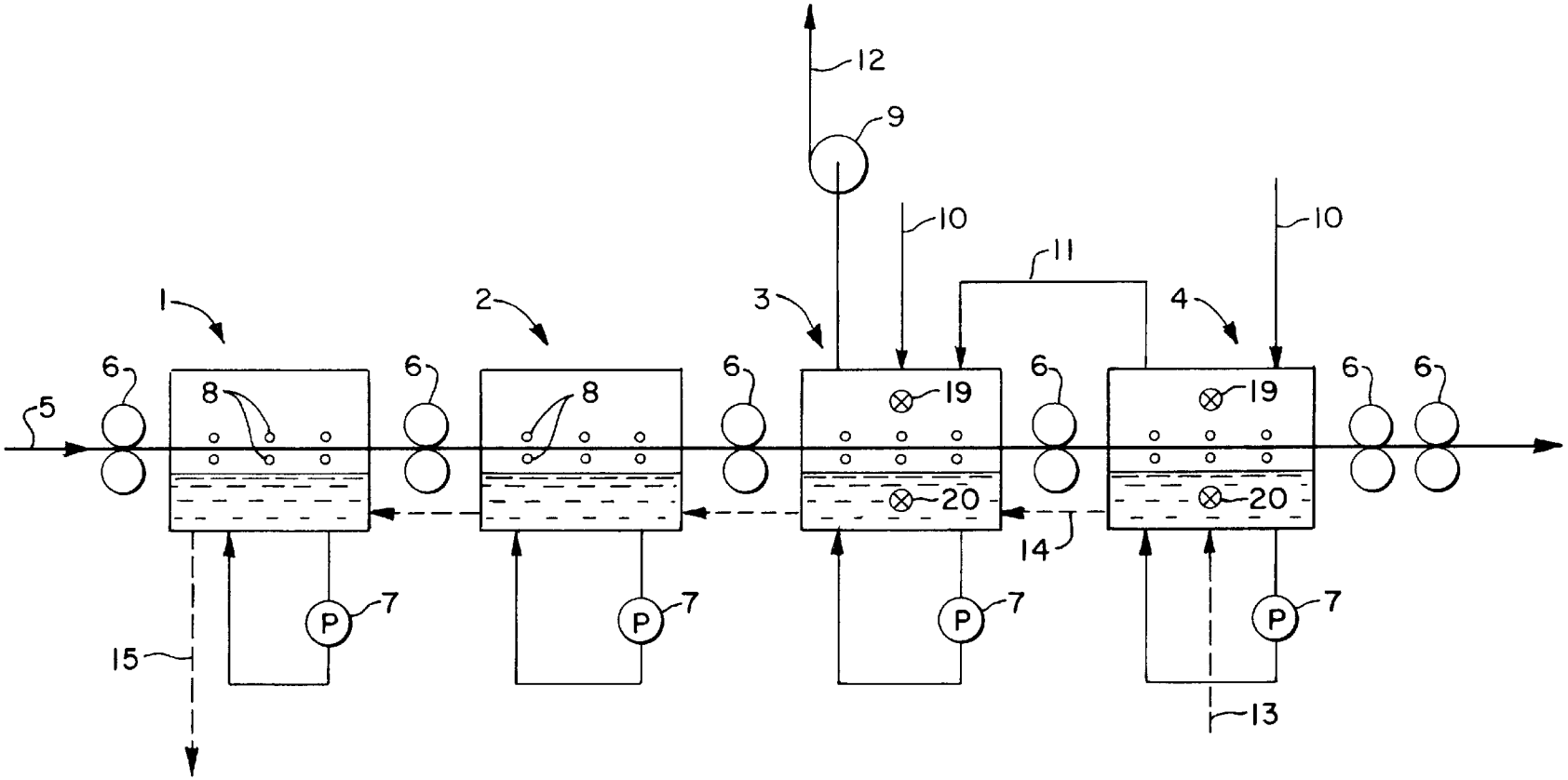
FIG. 1 schematically shows an exemplary version of the plant with a gas blow-in in the last two tanks of the rinsing section and FIG. 2 schematically shows a plant with gas circulation in an exemplary manner.

The four successive rinsing stages are designated by the reference numerals 1, 2, 3 and 4 in the two Figures, in the order in which the strip passes through them. Pairs of squeezing rollers 6 are arranged ahead of, between and after the four rinsing tanks 1, 2, 3 and 4. The rinsing water is circulated in each of the rinsing tanks 1,2,3 and 4 with one circulating pump 7 each, the water being applied to the steel strip 5 through sprayers 8.

In order to be able to flood the last two rinsing tanks 3 and 4 with inert gas, carbon dioxide or a mixture thereof in case of a plant malfunction, causing the strip to stand still, an exhaust gas fan 9 is provided at the pen ultimate rinsing stage 3, which extracts the air above the rinsing liquid through a duct 12. The inert gas, carbon dioxide or mixture of these two gases is blown into tanks 3 and 4 through ducts 10, which terminate at the feed openings 19, 20. Preferably a connection duct 11 is provided between the two tanks 3 and 4.

The feed openings 19 are arranged above the liquid level of the rinsing liquid in the appropriate rinsing tank 1,2,3 or 4 and, same as the exhaust gas fan 9 and the ducts 10, they are preferably sized such as to make it possible for the tank to be completely filled with the gas within a very short time, preferably within a maximum of 20 seconds. Complete filling means filling the volume above the liquid level with the gas up to a residual content of oxygen of approx. 1%.

Feed openings 20 located below the liquid level of the rinsing liquid in the appropriate tanks 1, 2, 3 or 4 for blowing in the gas, are particularly advantageous for feeding carbon dioxide, which can partly dissolve in the rinsing liquid and thus prohibits the hydrolysis reaction chemically as well.

The rinsing water is preferably fed to the last rinsing tank 4 via duct 13, then in the form of a counter-current cascade rinsing system, from the last rinsing stage 4 via connecting ducts 14 to the first rinsing stage 1 and extracted from there via a duct 15.

Figure 2:
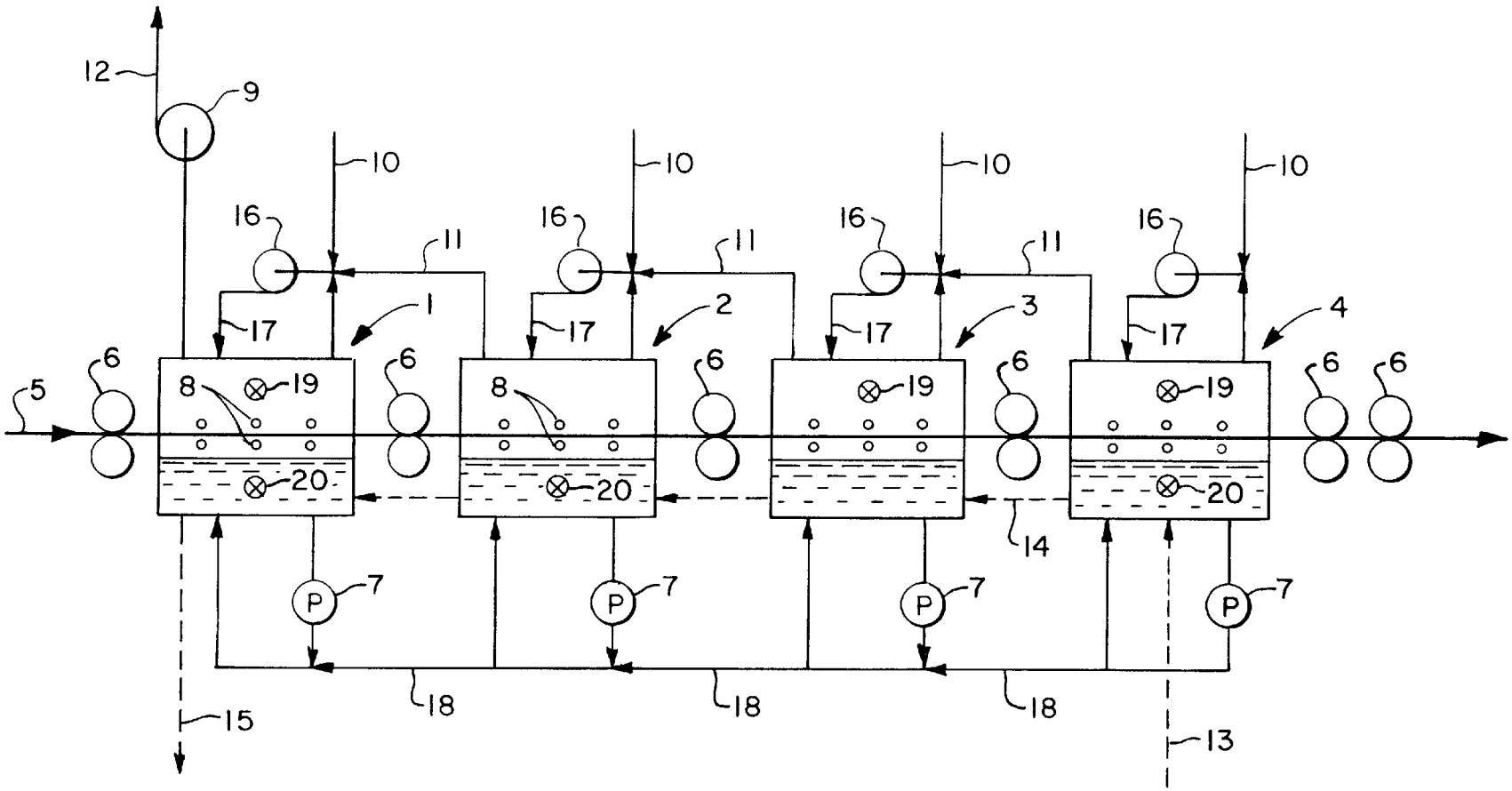

In FIG. 2 the same plant parts are designated by the same reference numerals as in FIG. 1. However, the exhaust gas fan is now provided in the first rinsing stage 1, and inert gas, carbon dioxide or a mixture thereof is fed to each rinsing tank 1,2, 3 and 4 via ducts 10 and the feed openings 19, 20.

A circulating blower 16 is provided at each rinsing tank 1, 2, 3 and 4, as is a circulating pipe 17 for the atmosphere contained therein. The individual rinsing tanks 1, 2, 3 and 4 are in turn connected via ducts 11.

The external circulation ducts for the rinsing water of the last three rinsing tanks 2, 3 and 4 are interconnected via pipes 18.

Working Examples:

Freshly pickled hot carbon steel strip quality grade St 37-2 was treated by spraying with rinsing water containing HCl in normal atmosphere (air). The overall HCl concentration was 0.2 g/l and 0.02 g/l respectively. The temperature of the rinsing liquid was between 60° and 80° C.

After a treatment time of approx. 30 seconds the first hydrolysis stains were noted on the strip surface (formation of visible hydrolysis products). As the treatment time progressed, this effect was intensified, i.e. the formation of hydrolysis products greatly increases. The strip surface colour changes to light brown and then dark brown.

The tests were then repeated using the same material and under the same conditions, and, by blowing nitrogen into the rinsing tank, an inert atmosphere was created in it. Even at extremely long treatment periods of 10 minutes no discolouring of the strip surface was noted, and it retains its bright, light-grey surface.

The same advantageous effect as in the previous test was also achieved by blowing argon into the rinsing tank, the requirements and conditions otherwise being unchanged. An additional advantage of argon is seen in the fact that its density is higher than that of air or nitrogen, so that penetration of secondary air into the rinsing tank is prevented or at least minimised on account of this difference in density.

In another test held under the same requirements and preliminary conditions as the previous tests, carbon dioxide was blown in, and the same advantageous effect was noted.

Also, when a mixture of carbon dioxide, rare gas or a mixture thereof were blown in, whereby the requirements and preliminary conditions were the same as described for the previous tests, the formation of hydrolysis stains was prevented on the surface.

We claim:

1. In a process for rinsing pickled, hot steel with water in at least one rinsing section of a continuous rinsing system, wherein the improvement is characterized in that carbon dioxide is blown into at least one rinsing section of the rinsing system.

2. Process according to claim 1, wherein a mixture of inert gas and carbon dioxide is blown in.

3. Process according to claim 2, wherein said mixture is continuously fed.

4. Process according to claim 2, wherein said mixture is discontinuously fed.

5. Process according to claim 2, wherein the strip passes through a space above a rinsing water level in each rinsing section and the mixture is blown in the space above the rinsing water.

6. Process according to claim 2, wherein the mixture is blown into the rinsing water.

7. Process according to claim 1, wherein carbon dioxide or a mixture of inert gas and carbon dioxide is blown into the last rinsing section of the rinsing system.

8. Process according to claim 7, wherein carbon dioxide or mixture of inert gas and carbon dioxide is blown into the last two rinsing sections.

9. Process according to claim 1, wherein the carbon dioxide is continuously fed.

10. Process according to claim 1, wherein the carbon dioxide is discontinuously fed.

11. Process according to claim 1, wherein the strip passes through a space above a rinsing water level in each rinsing section and the carbon dioxide is blown in the space above the rinsing water.

12. Process according to claim 1, wherein the carbon dioxide is blown into the rinsing water.

13. A process for producing carbon steel, including pickling hot carbon steel strip in a pickling system with pickling medium and immediately after pickling, rinsing the pickled strip with water in a continuous rinsing system having a plurality of rinsing sections in each of which rinse water can be sprayed into a space through which the strip can be conveyed, wherein the improvement comprises blowing carbon dioxide into at least one of the rinsing sections.

14. The process of claim 13, wherein the pickling medium is hydrochloric acid.

15. The process of claim 13, wherein carbon dioxide is blown into said space.

16. The process of claim 13, wherein the strip is conveyed through said space, with intermittent interruption, and the carbon dioxide is blown continuously into the rinsing section while the strip is conveyed and while such strip conveyance is interrupted.

* * * * *